US006701069B1

(12) United States Patent
Cezayirli et al.

(10) Patent No.: US 6,701,069 B1
(45) Date of Patent: Mar. 2, 2004

(54) PRE-HEATING CONTIGUOUS IN-LINE WATER HEATER

(76) Inventors: Cem Cezayirli, 801 Princeton Ave., Suite 310, Birmingham, AL (US) 35211; Mel Silvers, 18970 NE. 21st Ave., N. Miami, FL (US) 33179; Chester Z. Gates, 1761 Laurel Brook La., Birmingham, AL (US) 35215

( * ) Notice: Subject to any disclaimer, the term of this patent is extended or adjusted under 35 U.S.C. 154(b) by 0 days.

(21) Appl. No.: 10/365,072

(22) Filed: Feb. 12, 2003

(51) Int. Cl.[7] ..... F24H 1/10; H05B 3/78
(52) U.S. Cl. ..... 392/490; 392/494
(58) Field of Search ..... 392/490, 486, 392/485, 488, 491, 492, 494

(56) References Cited

U.S. PATENT DOCUMENTS 2,419,429 A * 4/1947 Voiles ..... 392/486
4,085,308 A 4/1978 Youngquist
4,436,983 A * 3/1984 Solobay ..... 392/490
4,567,350 A * 1/1986 Todd, Jr. ..... 392/486
4,723,065 A * 2/1988 Meyer ..... 219/205
4,808,793 A * 2/1989 Hurko ..... 392/489
5,129,034 A * 7/1992 Sydenstricker ..... 392/486
5,216,743 A * 6/1993 Seitz ..... 392/490
5,265,318 A 11/1993 Shero
5,892,887 A 4/1999 Thomas et al.
6,167,845 B1 * 1/2001 Decker, Sr. ..... 122/40
6,240,250 B1 * 5/2001 Blanco, Jr. ..... 392/490
6,539,173 B2 * 3/2003 Chu ..... 392/486

* cited by examiner

*Primary Examiner*—Edward K. Look
*Assistant Examiner*—Thor Campbell
(74) *Attorney, Agent, or Firm*—Bradley Arant Rose & White, LLP

(57) ABSTRACT

An improved pre-heating, contiguous in-line water heater is described. The in-line water heater utilizes a passive heating means to passively heat at least a portion of the input water received by the in-line water heater. The result is a more cost efficient water heater. The in-line water heater is integrated with a control means to receive input from various sensor and to regulate the operation of the in-line water heater.

30 Claims, 4 Drawing Sheets

PRE-HEATING CONTIGUOUS IN-LINE WATER HEATER

FIELD OF THE DISCLOSURE

The instant disclosure generally concerns water heaters. Specifically, the instant disclosure concerns pre-heating, in-line water heaters.

BACKGROUND

In-line water heaters (sometimes referred to as on-demand water heaters) are designed to heat a continuous supply of input water only when hot water is demanded by a user. This is in contrast to typical storage tank water heaters which keep, on the average, 30–70 gallons of water heated and ready for use 24 hours a day. Opening a hot water faucet triggers one or more heating units (typically, either electric or gas) to heat the water as it flows through the in-line water heater. The water takes a circuitous path through tubing in the in-line water heater so the heating units of the in-line heater have an opportunity to heat the water sufficiently. With in-line water heaters, there is never a shortage of hot water since there is never a tank to deplete. In addition, since there is no tank to heat continuously, there is a significant energy savings.

A conventional in-line water heater comprises a water input to allow water from the plumbing system to enter the water heater, a water output to distribute hot water for use, and a series of transit channels, or heating chambers, to direct the water through the in-line water heater. In many cases, these heating chambers are arranged in a baffle like arrangement which requires the water to travel an extended distance in the in-line water heater. Although the conventional in-line water heaters are more efficient than the storage tank water heaters, the conventional water heaters are not engineered to be as efficient as the in-line water heater described herein.

SUMMARY

The present disclosure describes a pre-heating, contiguous in-line water heater. One goal of the present disclosure to provide such an in-line water heater that is more cost efficient in use than conventional water heaters. An alternate goal of the present disclosure is to provide an in-line water heater that utilizes passive heating to heat the input water before the water is exposed to active heating by the heating elements as described herein. Another goal of the present disclosure is to provide an in-line water heater with an expandable capacity. Another goal of the present disclosure is to provide an in-line water heater incorporating a control means that provides at least one of the following functions: 1) monitoring the temperature of the input water as it travels through the in-line water heater; 2) monitoring the heating elements to determine which elements are in use at a given time; 3) providing an input means to set the temperature of the input water to a desired level (referred to as the "set temperature"); 4) determining how many of the heating elements are required to heat the input water to the set temperature and controlling the activation of said heating elements to achieve such heating; 5) monitoring the heating elements to determine which elements are functioning properly; 6) monitoring the system for free water, such as may occur from leaks; 7) monitoring the flow of input water through the system and activating at least one heating element when a flow is detected; 8) alerting the user when the in-line water heater is not functioning within a first set of parameters; and 9) providing the user of a visual display of a second set of parameter, such as the set temperature, the presence of a leak, the status of each of the heating elements, the current temperature of the input and/or output water and whether the in-line water heater is currently being supplied with power.

DETAILED DESCRIPTION

The present disclosure describes a pre-heating, contiguous in-line water heater. As with conventional water heaters, cold water is fed into the system (input water) heated as it travels through the in-line water heater. The in-line water heater described herein has several embodiments. The in-line water heater is described as being used with water, however, it should be understood that the in-line water heater can be used with other liquids as well, if desired. The embodiments described below are given for the purpose of example only such that one of ordinary skill in the art may understand the scope and content of the disclosure and is not meant to preclude other embodiments from the scope of the disclosure.

Figure 1:
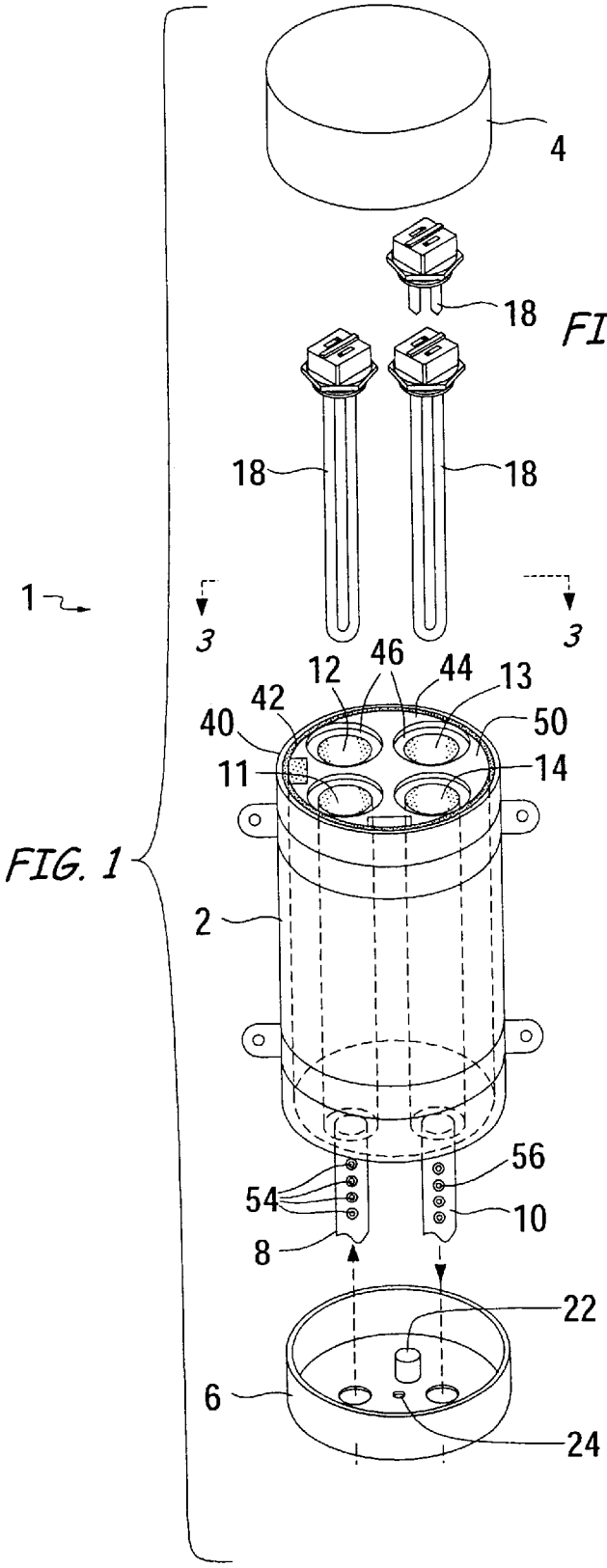
FIG. 1 shows a perspective view of one embodiment of the in-line water heater.
Figure 5:
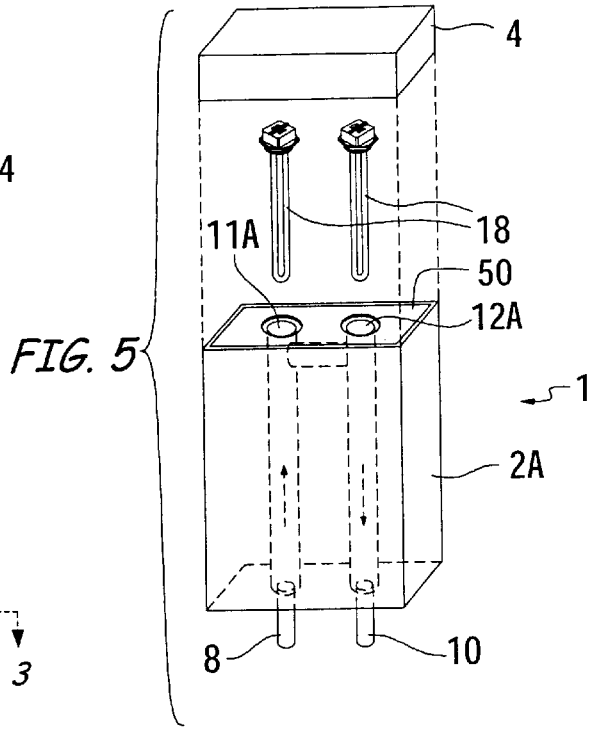
FIG. 5 shows an alternate embodiment of the in-line water heater.

FIG. 1 shows a perspective view of the in-line water heater of the present disclosure. The in-line water heater 1 comprises a body 2, a top cap 4 and a bottom cap 6. In one embodiment, the body 2 is generally cylindrical in form. However, the shape of the in-line water heater 1 may be varied as desired, with the cylindrical form being shown for exemplary purposes only. For example, FIG. 5 shows a body 2A of generally rectangular form. Other forms may also be used as desired. The body 2 comprises an outer periphery that at least partially defines an interior 50. The internal arrangement within interior 50 of body 2 may take on a number of forms. In its most basic form, the interior 50 of body 2 contains at least one transit channel to conduct input water from the cold water input 8 to the hot water output 10. There may be multiple transit channels which are interconnected, or there may be a single transit channel within the interior 50. All or less than all of the transit channels may contain a heating element to heat the input water as it travels through the in-line water heater 1. The interior 50 may further comprise a passive heating means. The function of the passive heating means is to transfer a portion of the heat generated by the in-line water heater to other sections of the in-line water heater and/or to retain heat in the nature of a heat sink. The heat transferred may be generated by the heating elements, for example. The passive heating means may comprise a variety of materials, such as, but not limited to, insulating foam, Styrofoam, asbestos, glass fiber insulation, metal, stone and sand. The metal may be a variety of metals included but not limited to, copper, a copper alloy, aluminum, an aluminum alloy, tin or a tin alloy, brass or a brass alloy, or any other metal that is capable of conducting heat and/or to retain heat in the nature of a heat sink. The interior 50 may be hollow or the interior 50 may be solid. When the interior 50 is solid, the solid acts as the passive heating means and the at least one transit tube may be cast within the solid interior. When the interior 50 is hollow particulate matter (as described above) acts as the passive heating means and the transit tubes may be surrounded with the particulate matter.

Figure 3A:
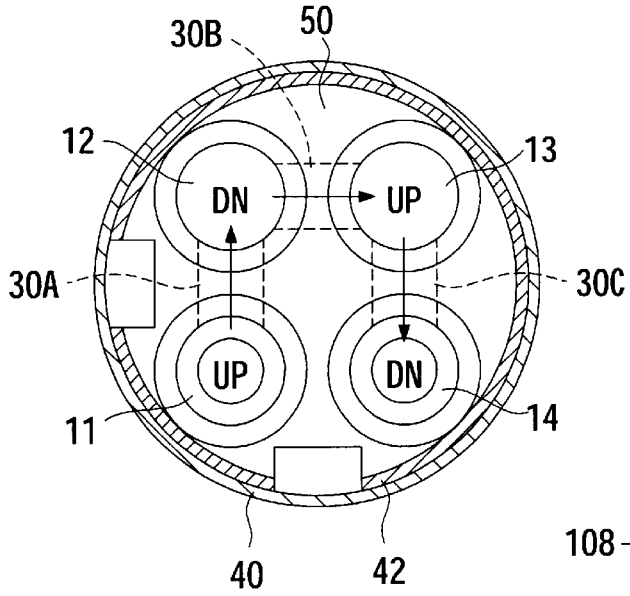
FIG. 3A shows a top view illustrating the internal arrangement of one embodiment of the in line-water heater illustrated in FIG. 1.
Figure 3B:
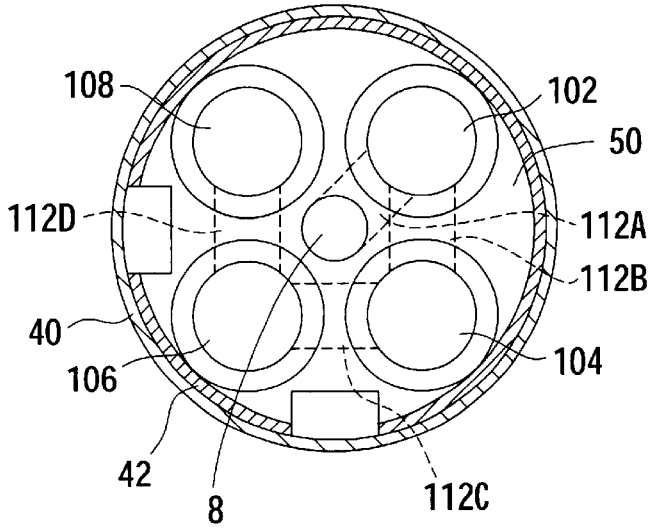
FIG. 3B shows a top view illustrating the internal arrangement of an alternate embodiment of the in line-water heater illustrated in FIG. 1.
Figure 7:
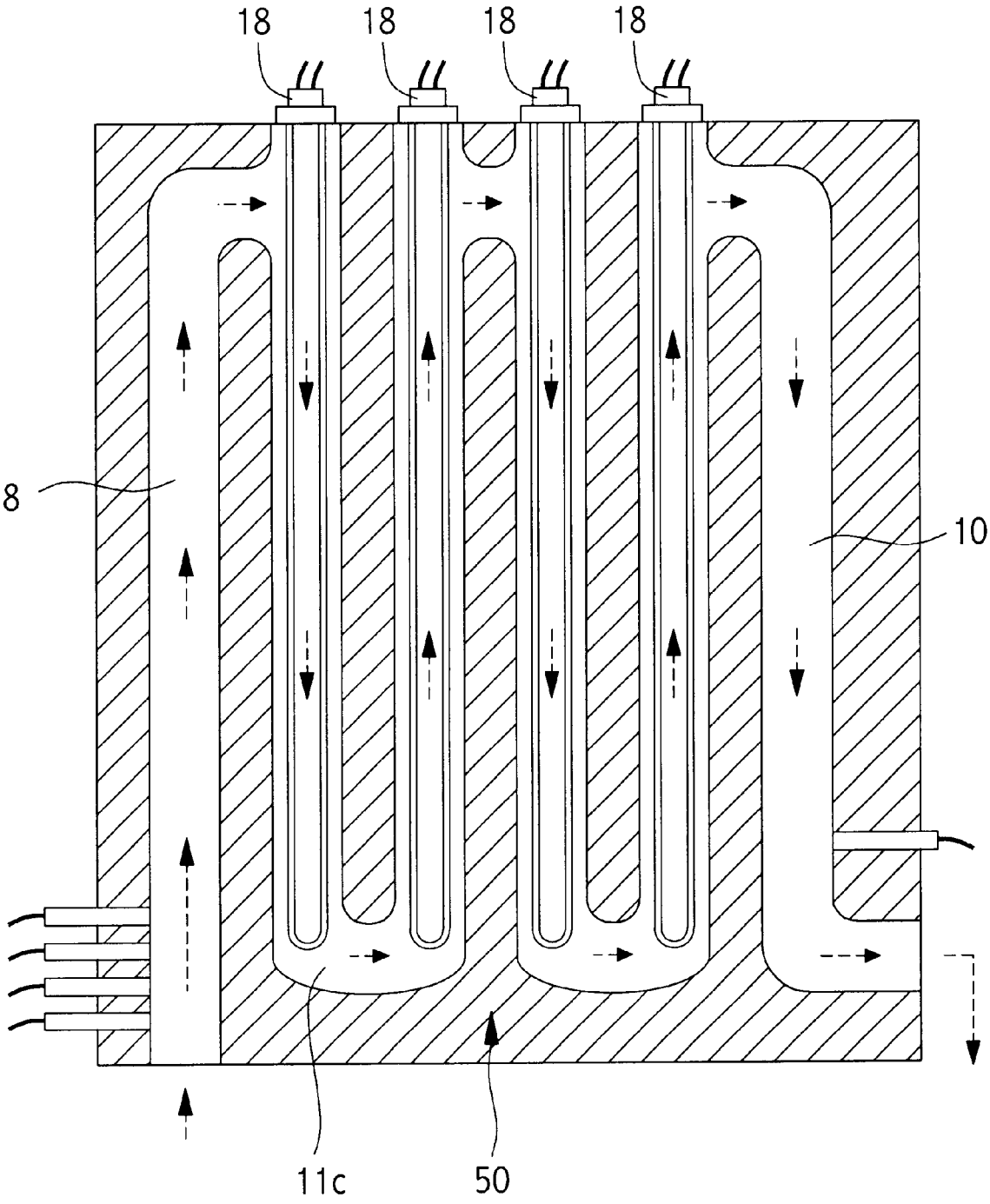
FIG. 7 shows a side view of an alternate embodiment of the in-line water heater illustrating a single, continuous transit channel.

So that one of ordinary skill in the art may understand the workings of in-line water heater 1, reference is made to the specific embodiments illustrated in the figures. As shown in FIG. 1, the interior 50 of body 2 is cast from a solid material. In this embodiment, the solid interior 50 serves as the passive heating means. FIG. 1 shows 4 interconnected transit channels labeled 11, 12, 13 and 14, which are cast in the solid interior 50. However, fewer or greater number of transit tube may be used. For example, FIG. 5 shows an embodiment of the in-line water heater 1 comprising two transit channels, 11A and 12A and FIG. 7 shows an embodiment of the in line water heater 1 having a single, continuous transit channel 11C. These transit channels are created in the casting process as hollow cavities within the solid interior 50. The transit channels 11–14 are interconnected with one another (as shown in FIG. 3 and discussed below). Furthermore, at least one of the transit channels is connected to the cold water input 8 and at least one of the transit channels is connected to the hot water output 10. The connections may be made by standard techniques known to one of ordinary skill in the art. In the embodiment illustrated in FIG. 1, transit pipe 11 is connected to cold water input 8 and transit pipe 14 is connected to hot water output 10.

One or more of the transit channels may contain a heating element 18 as shown in FIG. 1. FIG. 1 shows 3 heating elements 18, but each of the transit channels 11–14 may contain a heating element (as illustrated in FIG. 5, where transit channels 11A and 12A each contain a heating element 18). The purpose of the heating element is to heat the input water as it flows through the transit channels. The transit channels 11–14 may not extend all the way to the top portion 44 of solid interior 50 and may terminate slightly below the top portion 44 to produce a recess 46 to receive the heating element 18. The heating element 18 and the recess 46 may further comprise complementary male and female threads to removably secure the heating element 18 into the recess 46. The recess 46 may also contain a sealing means, such as a gasket or O-ring. The heating element 18 is in communication with a control means as discussed below. Briefly, the control means receives input from various sensors positioned in the in-line water heater 1 and controls the activation of the individual heating elements 18, among other things.

The number of heating elements 18 and or transit channels used will depend on the volume of water to be heated by the in-line water heater 1. Referring to the embodiment illustrated in FIG. 1, for a typical residential setting, three heating elements 18 and 4 transit channels 11–14 will generally provide sufficient quantities of hot water for use. When less than all of the transit channels 11–14 contain a heating element 18, it is preferred that the transit tube connected to the cold water input 8 not contain a heating element (transit tube 11 in this example). Once the heating elements 18 are activated by the control means as discussed below, the heating elements 18 will rapidly heat the solid interior 50 of the in-line water heater 1 via transduction of heat by the passive heating means. This will create conditions where the water flowing through transit tube 11 will be heated by the interior 50 of the in-line water heater 1 (referred to as "passive heating"). The use of passive heating allows additional heating of the water flowing through the in-line water heater 1 without the expenditure of additional energy and contributes to the efficiency of the unit. In initial studies the water is heated an average of 4–6 degrees Fahrenheit (F.) as it travels up transit pipe 11 (from an input temperature of 56 degrees F. to 60–62 degrees F.). This passive heating of the water occurs at no added energy expense to the system. In addition, the passive heating allows the water to be heated to the set temperature in a shorter time. In essence, the energy efficient design of the instant in-line water heater 1 allows a head start on the heating process at no added energy expense.

In commercial applications, each of the transit channels 11–14 may contain a heating element 18. Other factors that may influence the number of heating elements and/or transit channels to be incorporated include the climate of the area where the in-line water heater 1 is used. In temperate climates, three or fewer heating elements may be incorporated into the in-line water heater for use in a residential setting. In colder climates, four heating elements may be required to provide sufficient quantities of hot water. In addition, more transit channels could be incorporated into the in-line water heater 1 and used with or without heating elements 18. The size of the structure may also influence the number of heating elements used and/or the number of transit channels used. For larger structures, more heating elements and/or transit channels may be used as discussed above. Furthermore, the desired output temperature of the water may also influence the number of heating elements and transit channels used. Alternatively, more than one in-line water heater may be used to generate additional quantities of hot water.

Figure 2:
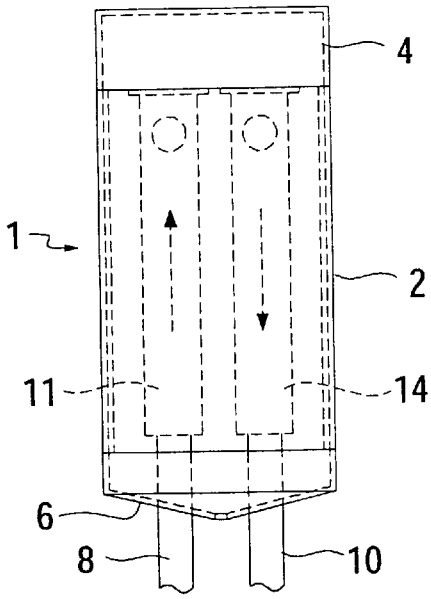
FIG. 2 shows a side view of one embodiment of the in-line water heater illustrated in FIG. 1.

FIGS. 2 and 3 illustrate an example of the flow of water through the in-line water heater 1. Input water (as normally supplied by standard systems) enters the in-line water heater 1 through the cold water input 8. The water travels up transit pipe 11. During the movement up transit pipe 11, the water is heated either passively as discussed above or via a heating element 18 which is in communication with the input water. The water reaches the top of transit pipe 11 and passes through connecting pipe 30A and travels down transit pipe 12 where it flows through connecting pipe 30B into transit pipe 13. The water flows up transit pipe 13, through connecting pipe 30C into transit pipe 14. The water flows down transit pipe 14 and out of the in-line water heater 1 through hot water output 10. The hot water is then distributed for use via standard feed pipes. As the water flows through transit channels 12–14 the water may be heated by heating elements18, which are in communication with the water when present. In addition, the water undergoes additional passive heating as described.

Figure 4:
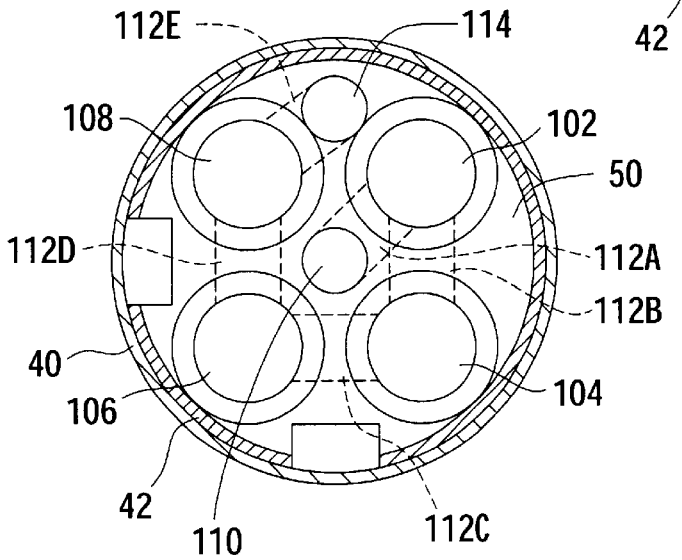
FIG. 4 shows a top view illustrating the internal arrangement of an alternate embodiment of the in line-water heater.

An alternate embodiment of the in-line water heater 1 is shown in FIG. 4. In this embodiment, there are 4 transit channels and the cold water input and hot water output extend into the interior 50 of the in-line water heater 1. In this embodiment, the cold water input and hot water output extend to just below the top portion 44. The cold water enters through transit pipe 110 which is connected to the cold water input (not shown). The water travels up transit tube 110 through connecting tube 112A into transit tube 102. The water travels down transit tube 102, through connecting tube 112B and up transit tube 104, through connecting tube 112C, down transit tube 106, through connecting tube 112D, up transit tube 108, through connecting tube 112E and down transit tube 114. The water exits transit tube 114 through the hot water output (not shown). In this embodiment, the transit channels 110 and 114 do not contain heating elements 118, although in an alternate embodiment heating elements could be used (as might be the case if it was desired to increase heating capacity). Instead, the water flowing through transit channels 110 and 114 is passively heated by the proximity to transit channels containing heating elements and via heat conducted by the passive heating means (in this embodiment solid interior 50). In an alternate embodiment, the passive heating means could be any one of the materials described above.

Referring to FIGS. 1 and 3, the body 2 has an outer covering 40 covering the solid interior 50. The outer covering 40 is optional, and functions to allow a user to handle the in-line water heater 1 when the unit is in operation. The outer covering 40 may be constructed of a variety of materials, including, but not limited to, various polymers (such as PVC), various plastics or metals (such as stainless steel). There may also be a layer of insulation between the outer covering 40 and the solid interior 50 (shown as 42 in FIGS. 1, 3 and 4).

The top cap 4 may contain connecting means for standard electrical connections for use with residential housing and commercial structures and a control means. In one embodiment, the top cap 4 may be divided into two sections, one containing the electrical connections and one containing the control means. The control means comprises electronics monitoring and regulating components. The electrical connections are those that are commonly used in the field and are well know to those of skill in the art. The control means also comprises standard components, the operation and arrangement of which are well known to those of skill in the art. The control means is in communication with the various sensors and regulators described below and is also in communication with the heating elements. The control means may contain a processing unit with sufficient memory and capacity to execute the functions described. The control means is capable of performing a number of self-monitoring and self-regulating functions regarding the in-line water heater. These functions include, but are not limited to: 1) monitoring the temperature of the input water as it travels through the in-line water heater; 2) monitoring the heating elements to determine which elements are in use at a given time; 3) providing an input means to set the temperature of the input water to a desired level (referred to as the "set temperature"); 4) determining how many of the heating elements are required to heat the input water to the set temperature and controlling the activation of said heating elements to achieve such heating; 5) monitoring the heating elements to determine which elements are functioning properly; 6) monitoring the system for free water, such as may occur from leaks; 7) monitoring the flow of input water through the system and activating at least one heating element when a flow is detected; 8) alerting the user when the in-line water heater is not functioning within a first set of parameters; and 9) providing the user of a visual display of a second set of parameter, such as the set temperature, the presence of a leak, the status of each of the heating elements, the current temperature of the input and/or output water and whether the in-line water heater is currently being supplied with power. Other functions that are used in water heaters as are currently known in the art may also be incorporated into the control means.

The visual display may be any means to visually inform the user of a desired aspect of the in-line water heater. For example, the visual display may be a LED display. The LED display may give the information in any convenient format. For example, the LED display may give the set temperature in a numeric readout and inform the user regarding the status of the heating elements through the use of individual display elements representing each heating element in the in-line water heater. If a heating element was in operation, a display element may be illuminated, or illuminated in a first color. If the heating element is not operating correctly, the display element may be illuminated in a second color. Such display element may simply be a circular LED, or may be graphical in nature.

In addition to a visual display, the in-line water heater may comprise an alarm to alert the user when the in-line water heater is not functioning within established parameters, such as when a leak is detected, when a heating element is not functioning properly, when a block is detected in the transit channels or when the heating elements in operation cannot supply input water at the set temperature for sustained periods of time. For example, if the in-line water heater is not able to generate water meeting the set temperature requirement, an alarm may be generated. In addition, an alarm may be generated when one of the heating elements fails to function properly. Any aspect of the functioning of the control means may be linked to an alarm. The methods for linking such functions to an alarm are known to those of skill in the art. The alarm may be an audible alarm, a visual alarm or a combination of a audible alarm or a visual alarm.

The control means may receive signals from a flow detection means. The flow detecting means is in fluid communication with the water input into the in-line water heater. The flow detection means may be a flow detector (illustrated as 16 in FIG. 1). The operation and integration of flow detectors as described is within the ordinary skill in the art. The flow detection means would signal the control means when water was flowing thought the in-line water heater. The signal would cause the control means to activate a sufficient number of heating elements in order to heat the input water to the set temperature. In some cases all of the heating elements may be activated and in some cases less than all of the heating elements may be activated. Location of the flow detecting means may be any position where the flow detecting means has access to determine the flow of water through the system. In one embodiment, the flow detecting means is located in conjunction with cold water input 8. In an alternate embodiment, the flow detecting means is located in conjunction with hot water output pipe 10. In other embodiments, the flow detecting means may be placed in conjunction with transfer tubes (such as transfer tubes 11–14 in FIG. 1).

In addition to monitoring the flow of water through the system, the in-line water heater described can also monitor the temperature of the input and output water through the use of temperature detecting means. The temperature detecting means is in fluid communication with the water input into the in-line water heater. Alternatively, the temperature detecting means may be in communication with the exterior of the transit channels and be calibrated to determine the temperature of the water from the temperature of the transit channels. The temperature detecting means may be temperature sensors as are common in the field. The operation and integration of temperature detecting means as described is within the ordinary skill in the art. As with the flow detecting means, the temperature detecting means may be positioned at any position where the temperature detecting means has access to the water flowing through the system. In one embodiment the temperature detecting means are located in conjunction with hot water outlet pipe 10.

There may be multiple temperature detecting means to monitor the temperature of the water at various stage of transit through the in-line water heater. In one embodiment, the control means compares the temperature of the output water to the set temperature and determines the difference between the two. If this difference is large, then the control means activates all available heating elements. This may occur when the flow detecting means first detects a flow of water through the system. As the difference becomes smaller, then the control means may inactivate one or more heating elements. The control means can be set to respond as desired to a range of differences between the temperature of the output water and the set temperature. In one embodiment where three heating elements are present, when the difference is at least 25 degrees F., all three heating elements are activated. When the difference is between 24 and 10 degrees F., then two heating elements are activated. When the difference is between 9 and 1 degrees F., then only one heating element is activated. Finally, when the temperature of the output water is equal to or greater than the set temperature, no heating elements are activated. Other temperature parameters may be selected with the above parameters being exemplary only.

The in-line water heater may also contain a leak detection means. The leak detection means may be a sensor capable of sensing the presence of free water in the system. The operation and integration of the leak detecting means as described is within the ordinary skill in the art. The leak detection means may be located at any desired location, but in one embodiment the leak detection (illustrated as 22 in FIG. 1) is located near the drain 24 in bottom cap 6. If the leak detection means senses free water, then the leak detection means may signal the control means to sound an audible alarm and/or a visual alert to the user.

The bottom cap 6 functions to cover the bottom of the in-line water heater 1. The bottom cap 6 has openings therein to receive the cold water input 8 and the hot water output 10. In addition, the bottom cap 6 comprises a drain 24. The bottom of bottom cap 6 may be concave to allow the collection and drainage of water that may escape from the in-line water heater 1. As discussed above, the leak detecting means may be placed near the drain 24.

The top cap 4 and bottom cap 6 are adapted with an engagement means to securely and reversible engage the body 2. The engagement means may employ a snap/friction fit, one or more hinges, the use of complementary male and female threads on the top cap 4 and/or bottom cap 6 and the body 2, a combination of the above, or other commonly used means. In addition, there may be a gasket or other sealing means to separate the contents of the top cap 4 from the body 2. Since the top 4 and bottom 6 caps are removable, the system may be easily accessed for maintenance and repair. For example, if the control means indicated that a heating element is not functioning properly (either by a visual alarm, an audible alarm or both as discussed above), the top cap 4 may be removed. The LED display would indicate which heating element was not functioning correctly. The suspect heating element could then be removed by simply unscrewing the heating element and replacing the heating element with a new one if required.

It should be noted that the in-line water heater described herein incorporates certain standard features that are common on both in-line water heaters and/or storage tank water heaters. These features and their applicability to the in-line water heater described herein are within the ordinary skill in the art in the plumbing field and are not discussed in detail. Such features include those described above such as electrical connections, flow detecting means, temperature detecting means, leak detecting means, but also include features such as, but not limited to, relief valves and standard connecting elements and couplings.

The water heater describe is energy efficient in use for a number of reasons. First, the heating elements of the in-line water heater are only in use when water is flowing through the system. When the flow detection means does not detect a flow of water through the in-line water heater, the heating elements are maintained in an inactive state. Second, the in-line water heater is constructed from materials that retain the heat produced by the heating elements and the heated water. As a result, the body of the in-line water heater serves to passively heat the water flowing through the system. In addition, the water that is contained in the in-line water heater will retain its heat for a longer period of time. Third, the control means of the in-line water heater monitors the temperature of the output water and compares that temperature to the set temperature to determine how many of the heating elements are required to be in operation in order to maintain the temperature of the output water at the set temperature. If there is a large gap between the temperature of the output water and the set temperature, the control means activates all available heating elements. As the gap becomes smaller fewer that all the heating elements are activated by the control means.

Figure 6:
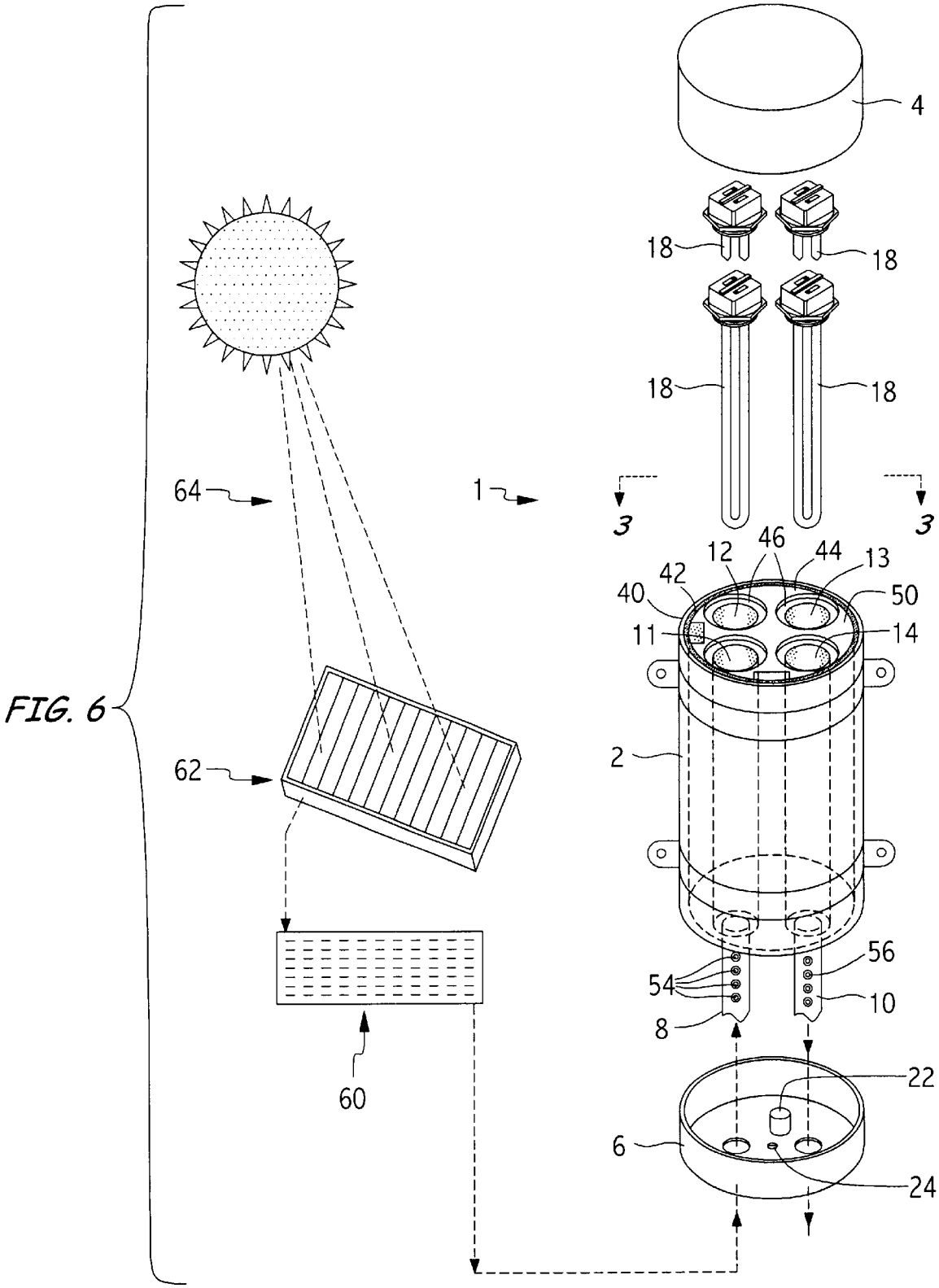
FIG. 6 shows an alternate embodiment of the in-line water heater where the input water is pre-heated by solar heating.

An additional alternate embodiment of the in-line water heater 1 is described below and illustrated in FIG. 6. The basic concepts of the operation of the in-line water heater 1 remain the same as described above. In this embodiment, the input water for the in-line water heater is not drawn directly from the water normally supplied to the structure. Instead, the water is drawn from an intermediary holding tank 60. The water in the intermediary holding tank may be heated before being delivered to the in-line water heater 1. The heating may be by any means, such as gas or electric. Alternatively, the tank may not be directly heated, but may be heated by solar energy (illustrated in FIG. 6 as solar panel 62 being irradiated by solar rays 64) or other means. The temperature of the intermediary holding tank will ideally be above that of the water that would otherwise be supplied to the in-line water heater 1.

The features of the new in-line water heater described herein are not meant to be an exhaustive listing of features, but only to provide a general idea of the operation of the system. Other features may be apparent to those of ordinary skill in the art.

What is claimed:

1. An in-line water heater for heating input water comprising:

a. a body having an outer perimeter that partially defines an interior, said interior comprising at least one transit channel for transporting said input water through said water heater and a passive heating means;

b. a water input in communication with a first end of said at least one transit channel to deliver said input water to said water heater and a water output in communication with a second end of said at least one transit channel to distribute said water to at least one feeder pipe;

c. at least one heating element in combination with said at least one transit channel, said heating element being in communication with and heating said input water; and d. where at least a portion of said input water is passively heated by a transfer of heat from said passive heating means to said input water.

2. The water heater of claim 1 where the passive heating means is selected from the group consisting of insulating foam, Styrofoam, asbestos, glass fiber insulation, metal, stone and sand.

3. The water heater of claim 2 where the metal is selected from the group consisting of copper, aluminum, brass, tin and alloys thereof.

4. The water heater of claim 1 where said passive heating means is a solid metal and the at least one transit channel is cast within said solid metal.

5. The water heater of claim 1 where the at least one transit channel is a single transit channel.

6. The water heater of claim 1 where the interior comprises at least four interconnected transit channels and not more than three heating elements in combination with said transit channels.

7. The water heater of claim 6 where the transit channel in communication with said water input does not contain a heating element.

8. The water heater of claim 6 where the interior comprises not more than 4 heating elements.

9. The water heater of claim 1 where at least one of the water input or water output extend into said interior.

10. The water heater of claim 9 where said at least one of the water input or water output extend to an uppermost portion of said interior.

11. The water heater of claim 10 where the degree of said passive heating is proportional to the length of said at least one of the water input or water output.

12. The water heater of claim 9 where at least one of the water input or the water output is placed into proximity with said at least one transit channel to increase the efficiency of said passive heating.

13. The water heater of claim 1 where said interior comprises at least four interconnected transit channels and not more than three heating elements in combination with said transit channels and where said water input and said water output extend to an uppermost portion of said interior.

14. The water heater of claim 13 where the degree of said passive heating is proportional to the length of said water input and water output.

15. The water heater of claim 13 where at least one of the water input or the water output is placed into proximity with at least one transit channel to increase the efficiency of said passive heating.

16. The water heater of claim 1 where the input water is pre-heated before delivery to said water heater.

17. The water heater of claim 16 where said pre-heating utilizes solar heating.

18. The water heater of claim 1 further comprising an outer covering over the outer perimeter.

19. The water heater of claim 18 where the outer covering is manufactured from a material selected from the group consisting of polymers, plastics and metals.

20. The water heater of claim 18 further comprising a layer of insulating material between the outer perimeter and the outer covering.

21. The water heater of claim 1 where said water input further comprises a flow detecting means and said water output further comprises a temperature detecting means.

22. The water heater of claim 1 further comprising a top cap and a bottom cap removably secured to said body.

23. The water heater of claim 22 where said top cap contains a control means and a connecting means and said bottom cap contains a leak detecting means and a drain.

24. The water heater of claim 1 further comprising at least one sensor and a control means in communication with said at least one heating element and said at least one sensor.

25. The water heater of claim 24 where the at least one sensor is selected from the group consisting of a flow detection means, a temperature detecting means and a leak detecting means.

26. The water heater of claim 25 where the control means performs at least one function selected from the group consisting of: 1) monitoring the temperature of said input water as said input water flows through said water heater; 2) monitoring said heating elements to determine which of said elements are in use at a given time; 3) providing an input means to set the set temperature; 4) determining how many of said heating elements are required heat said input water to the set temperature; 5) monitoring said heating elements to determine if said elements are functioning properly; 6) monitoring said water heater for a leak; 7) monitoring a flow of input water through said water heater and activating said heating elements only when said flow is detected; 8) alerting a user when said water heater is not functioning within a first set of parameters by activating an alarm; and 9) providing said user a visual display of a second set of parameters.

27. The water heater of claim 26 where the alarm is a visual alarm, an audible alarms or a combination of a visual alarm and an audible alarm.

28. The water heater of claim 26 where the first set of parameters include at least one parameter selected from the group consisting of: detection of a leak, detection of a heating element that is not functioning properly, detection of a blockage in the transit channels and detection of an inability to heat said input water to the set temperature.

29. The water heater of claim 26 where the visual display is an LED display.

30. The water heater of claim 26 where said second set of parameters include at least one parameter selected from the group consisting of: set temperature, current temperature of input water, on/off state of the heating elements; status of the individual heating elements and whether said water heater is receiving power.

* * * * *